United States Patent [19]

Kawabata

[11] Patent Number: 4,721,224

[45] Date of Patent: Jan. 26, 1988

[54] PRESSURE VESSEL HAVING PRESSURE RELEASING MECHANISM

[75] Inventor: Chouji Kawabata, Gunma, Japan

[73] Assignee: Nittoseiki Kabushiki Kaisha, Gunma, Japan

[21] Appl. No.: 948,414

[22] Filed: Dec. 31, 1986

[51] Int. Cl.[4] ..... B65D 83/14

[52] U.S. Cl. ..... 220/89 A; 220/469; 220/207

[58] Field of Search ..... 220/89 A, 207, 203, 220/466, 469

[56] References Cited

U.S. PATENT DOCUMENTS

| | | | |
|---|---|---|---|
| 2,795,350 | 6/1957 | Lapin | 220/89 A X |
| 3,327,894 | 6/1967 | Ferris | 220/89 A |
| 3,680,743 | 8/1972 | Reinnagel | 220/89 A |
| 3,815,534 | 6/1974 | Kneusel | 220/89 A X |
| 3,831,822 | 8/1974 | Zundel | 220/89 A X |
| 3,850,339 | 11/1974 | Kinkel | 220/89 A |
| 3,918,610 | 11/1975 | Willis | 220/207 |
| 4,513,874 | 4/1985 | Mulawski | 220/89 A |

*Primary Examiner*—Steven M. Pollard

*Attorney, Agent, or Firm*—Browdy and Neimark

[57] ABSTRACT

A can has a cylindrical metal can body having a bottom and a metal upper lid double-seamed thereto. It also has a recess for the engagement of a seaming chuck which is formed in the upper surface of the upper lid, and which is made to project into the interior of the can body by the seaming to make a cavity thereinto. The bottom of the recess has a plurality of score lines extending in the circumferential direction.

3 Claims, 11 Drawing Figures

PRESSURE VESSEL HAVING PRESSURE RELEASING MECHANISM

BACKGROUND OF THE INVENTION

1. Field of the Invention

The present invention relates to a pressure vessel having a pressure releasing mechanism which allows the pressure in the vessel to escape by itself when the internal pressure thereof has increased to such an extent as to blow off the lid of the vessel.

A pressure vessel mentioned herein refers to a vessel containing a quick lime which reacts exothermically with water when brought into contact therewith so as to heat a food or a pharmaceutical product separately accommodated in the vessel by the heat generated by the contact between the quick lime and water, or an aerosol vessel containing a cosmetic preparation and a liquefied gas.

Such a pressure vessel generally has a pressure releasing mechanism to prevent any explosion that would occur if an excessive exothermic reaction takes place in the former type of vessel, or if the internal pressure is excessively increased because the latter type of vessel has been thrown into a fire.

2. Description of the Prior Art

A conventional pressure releasing construction for a pressure vessel of this type has been disclosed in the specification of Canadian Patent No. 957,628.

In this pressure releasing construction, a metal upper lid b is double-seamed to a metal can body a of an aerosol vessel, as shown in FIGS. 10 and 11. A vertical lid plate portion c of the metal upper lid b which abuts against the inner wall of the can body has a large number of score lines d extending in the radial direction, each starting from halfway down the vertical lid plate portion c and extending over the top of the seaming. If the upper lid b is deformed from the state shown in FIG. 10 to the state shown in FIG. 11 by an increase in the internal pressure, the score lines d are broken so as to release the internal pressure therethrough, thereby preventing blow-off of the upper lid b. In such a construction, however, since the score lines d are provided over the seamed portion of the lid, they cannot be broken until the vertical lid plate portion c of the upper lid b and the top portion extending therefrom have been deformed to such an extent that they have risen. This means that there is the danger of a time lag between the excessive rise of the internal pressure and the escape of the pressure. In addition, it is illogical in terms of the function originally required of the internal pressure vessel to provide the score lines d in the portion of the lid which is to be firmly seamed to make the vessel completely air-tight.

SUMMARY OF THE INVENTION

In the present invention it is noted that an engagement recess for a seaming chuck which is formed in the upper surface of the upper lid is made to project into the interior of the can body to form a cavity thereinto by the seaming of the upper lid to the can body and is subjected to pressure, and is considered releasing the internal pressure by providing score lines in the bottom of the recess and by allowing these score lines to break immediately once the internal pressure rises excessively.

To accomplish the object of the present invention, there is provided a pressure vessel having a pressure escaping mechanism, the pressure vessel including a cylindrical metal can body having a bottom, a metal upper lid which is double-seamed to the can body, and an engagement recess for a seaming chuck which is formed in the upper surface of the upper lid and which is made owing to the seaming to project into the interior of the can body to form a cavity thereinto, wherein the pressure vessel is characterized by comprising a plurality of score lines formed on the bottom of the recess and extending in the circumferential direction.

BRIEF DESCRIPTION OF THE DEDRAWINGS

DESCRIPTION OF THE PREFERRED EMBODIMENTS

A first embodiment of the present invention will be described hereinunder with reference to FIGS. 1 to 6.

In the first embodiment of the pressure vessel, a metal upper lid 3 is double-seamed to a cylindrical metal can body 2 having a bottom 1. This leaves a space 13' between the can body 2 and the cylindrical wall defining the recess 10, the space 13' extending approximately halfway to the bottom 1 of the can body 2.

Figure 1:
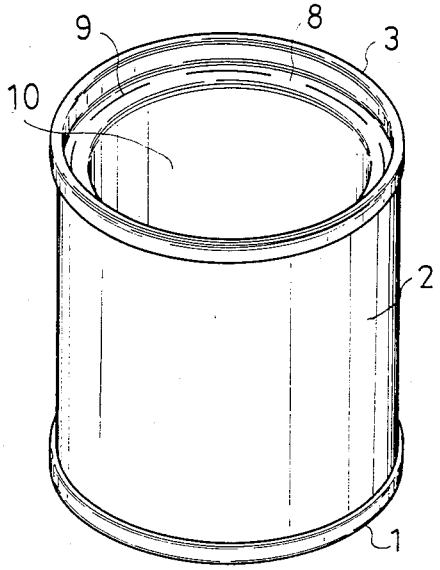
FIG. 1 is a perspective view of a first embodiment of a pressure vessel according to the present invention.
Figure 2:
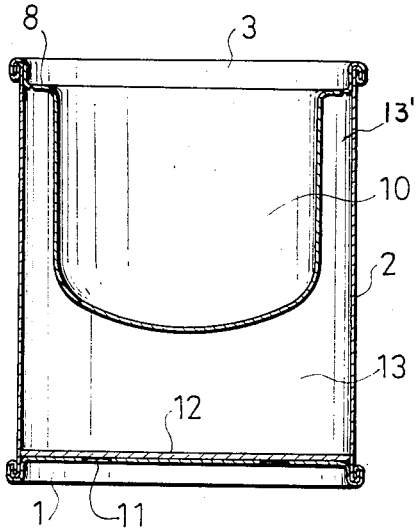
FIG. 2 is a cross-sectional view of the pressure vessel of FIG. 1.
Figure 3:
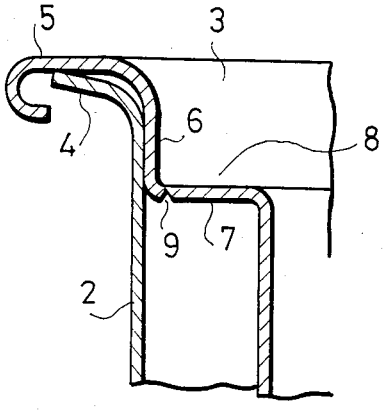
FIG. 3 is a cross-sectional view of a portion of the pressure vessel which is about to be seamed.
Figure 4:
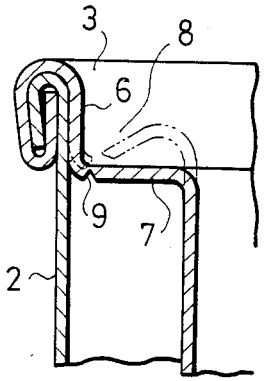
FIG. 4 is a cross-sectional view of the portion of the pressure vessel which has been seamed, with a score line provided on the lower surface thereof.
Figure 5:
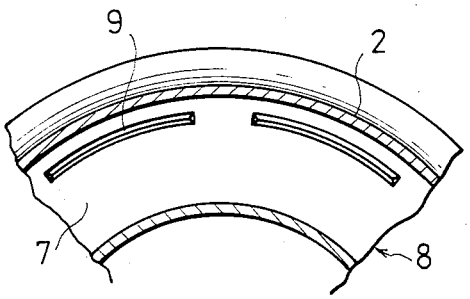
FIG. 5 is a top plan view of the portion of FIG. 4.

The construction of this seaming is as follows. The can body 2 has an overhanging flange 4 at the edge of an upper opening thereof, as shown in FIG. 3, while the upper lid 3 has a flange 5 which is to be seamed together with the flange 4. Inside the flange 5, an engagement recess 8 for a seaming chuck is formed beforehand by both a side plate 6 extending vertically, as viewed in the cross-section, and a bottom plate 7 provided at the bottom of the side plate 6 and extending therefrom in the horizontal direction. When the chuck is engaged in the recess 8, and the flange 4 of the can body 2 and the flange 5 of the upper lid 3 are seamed together by means of the chuck and an external roller by a usual method, the recess 8 is inevitably made to protrude thereby into the interior of the can body 2, as shown in FIG. 4

Figure 6:
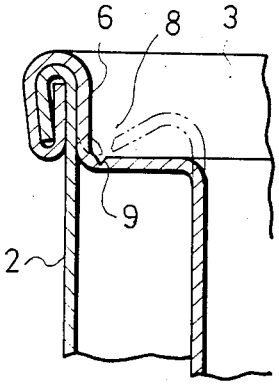
FIG. 6 is a cross-sectional view of a portion of the pressure vessel which has been seamed, with a score line provided on the upper surface thereof.

The first embodiment of the present invention is characterized by the provision of a plurality of score lines 9 on the bottom plate 7 of the recess 8, extending in the circumferential direction. The score lines 9 are preferably provided as close to the vertical plate portion 6 as possible, as shown in the drawing. It is also preferable for them to be provided on the lower surface of the bottom plate 7, as shown in FIG. 4. However, they may be formed on the upper surface thereof, as shown in FIG. 6.

The thus-arranged pressure vessel is a pharmaceutical vessel. It has a recess 10 formed in the upper lid 3 for accommodating a pharmaceutical, holes 11 formed in the bottom lid 1 of the can body 2 through which can water enter the can body, and a water absorption member 12 which blocks each hole 11. When the bottom of the can body 2 is placed on an article such as a dish filled with water in a state wherein an interior 13 of the can body 2 contains quick lime, water enters through the holes 11 and comes into contact with the quick lime contained in the can body, generating an exothermic reaction. The heat generated by this reaction then causes the pharmaceutical contained in the recess 10 to spray outward.

Consequently, the pressure in the can body 2 will greatly increase if the amount of water which makes contact with the quick lime is excessive.

If an excessive rise in the internal pressure occurs, the pressure acts on the weakened portions of the upper lid which constitute the score lines 9, breaking them and escaping outward therethrough.

Figure 7:
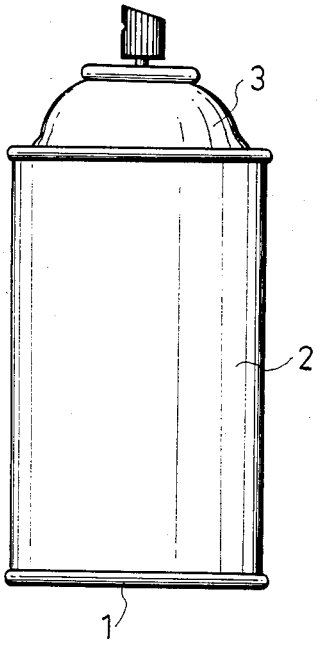
FIG. 7 is a front view of a second embodiment of a pressure vessel (aerosol vessel) according to the present invention.

A second embodiment of the present invention will be described hereinunder with reference to FIGS. 7 to 9.

The internal pressure vessel of this embodiment is an aerosol vessel. Therefore, in this vessel, the upper lid 3 has a dome-like configuration, and the recess 8 for chuck engagement which is provided to enable the seaming of the upper lid 3 and the can body 2 takes the form of a groove, as viewed at the cross section, which is formed along the inner periphery of the can body 2. This recess also projects into the interior of the can body 2 to form a cavity thereinto, like that of the first embodiment.

The pressure vessel of this embodiment has a plurality of score lines 9 formed in the bottom of the groove-like recess 8 in such a manner that they extend in the circumferential direction.

Figure 8:
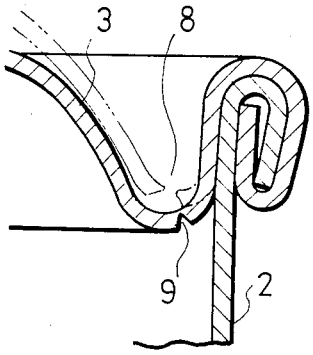
FIG. 8 is a cross-sectional view of a portion of the pressure vessel of FIG. 7, with a score line provided on the lower surface thereof.
Figure 9:
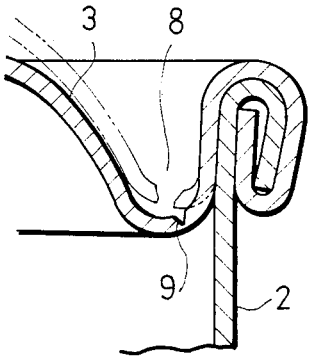
FIG. 9 is a cross-sectional view of a portion of the pressure vessel of FIG. 7, with a score line provided on the upper surface thereof.
Figure 10:
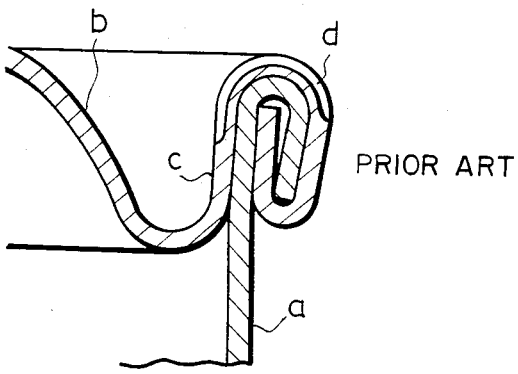
FIG. 10 is a cross-sectional view of a portion of a conventional pressure vessel, with a score line provided on a seamed portion thereof.
Figure 11:
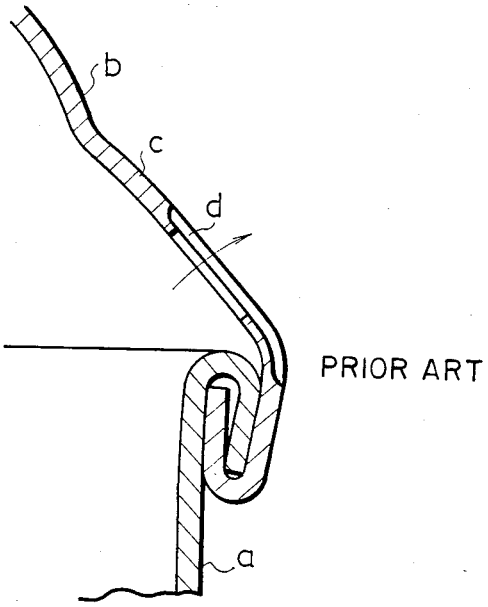
FIG. 11 is a cross-sectional view of a portion of FIG. 10 which is in the state wherein it has released the internal pressure.

The score lines 9 are preferably formed in the lower surface of the recess 8, as shown in FIG. 8. However, they may be provided on the upper surface, as shown in FIG. 9.

Consequently, if the aerosol vessel is thrown into a fire, an increased pressure acts on the weakened portions of the lid which constitute the score lines 9, breaking them and releasing the pressure outward therethrough.

In accordance with the present invention, the score lines through which the internal pressure is released are not formed in the seamed portion but in a portion which is not related thereto, i.e., in the recess for the engagement of the seaming chuck which must be provided for the seaming and which is made to project into the interior of the can body by the seaming to form a cavity thereinto. Consequently, the score lines can be broken in the initial stages of the generation of the pressure, when the generated pressure does not yet affect the seamed portion, thereby eliminating the possibility of exploding the vessel.

What is claimed is:

1. A drug atomizing vessel comprising a metallic inner cylinder having a bottom, said inner cylinder containing a drug to be atomized, a metallic outer cylinder with a respective bottom, said outer cylinder being concentrically connected at a top part thereof with a top part of said inner cylinder, so that said bottom of said inner cylinder extends approximately halfway to said bottom of said outer cylinder and so that a concentric space separates said inner cylinder from a respective upper cylindrical part of said outer cylinder, liquid passing means in said bottom of said outer cylinder for allowing liquid to enter therethrough into said outer cylinder without releasing pressure from between said inner and outer cylinders, an exothermic agent in said outer cylinder between said bottoms of said cylinder and in said concentric space between said cylinders, for providing pressure when said liquid enters via said liquid passing means into said outer cylinder, wherein said top portion of said inner cylinder is formed in the shape of a flange extending at right angles to the walls of said cylinders toward said outer cylinder and with a further part extending up an inner surface of the top of the outer cylinder and to be double seamed with the top of said outer cylinder, score lines are concentrically provided in a surface of said flange in the vicinity of where it connects to said further part extending up, and said flange is torn apart from said further part at said score lines when said pressure is provided.

2. The vessel of claim 1, said score lines being on a bottom surface of said flange where it connects to said further part.

3. The vessel of claim 1, said score lines being on a top surface of said flange where it connects to said further part.

* * * * *